United States Patent [19]

Schield et al.

[11] Patent Number: 5,022,206

[45] Date of Patent: Jun. 11, 1991

[54] ENTRY DOOR SYSTEM

[75] Inventors: Edward L. Schield, Medford; Myron D. Reeves, Ladysmith; Marjorie A. Nehiba; Lyn W. Hartl, both of Medford, all of Wis.

[73] Assignee: Weather Shield Mfg., Inc., Medford, Wis.

[21] Appl. No.: 468,859

[22] Filed: Jan. 19, 1990

[51] Int. Cl.[5] ..... E06B 3/70

[52] U.S. Cl. ..... 52/455; 52/456; 52/309.9; 52/313; 49/171; 49/501

[58] Field of Search ..... 52/207, 208, 309.9, 52/313, 415, 455, 456, 806, 807, 810, 811, 829; 49/171 X, 501 X, 503

[56] References Cited

U.S. PATENT DOCUMENTS

| | | | |
|---|---|---|---|
| 1,257,476 | 2/1918 | Gervais . | |
| 2,286,493 | 6/1942 | Lowry | 52/455 |
| 3,491,584 | 1/1970 | Selzer | 49/501 |
| 3,885,351 | 5/1975 | Imperial et al. | 52/829 X |
| 4,367,614 | 1/1983 | Warwick | 52/455 |
| 4,546,585 | 10/1985 | Governale . | |
| 4,630,420 | 12/1986 | Hagemeyer . | |
| 4,702,054 | 10/1987 | Turner | 52/455 X |
| 4,882,877 | 11/1989 | Guehe, Jr. et al. | 52/456 X |

FOREIGN PATENT DOCUMENTS

| | | | |
|---|---|---|---|
| 509078 | 2/1952 | Belgium | 52/810 |

*Primary Examiner*—Richard E. Chilcot, Jr.
*Assistant Examiner*—Creighton Smith
*Attorney, Agent, or Firm*—Price, Heneveld, Cooper, DeWitt & Litton

[57] ABSTRACT

An entry door system constructed of panels having a metal skin filled with insulating rigid foam core and having a unique wood facing and whereby the system has exceptional insulating qualities while projecting the beauty of a wood door. The system includes door and side panel components of substantially the same construction, except for the size, and provides for a versatile arrangement of panel components which in different selected combinations can be secured together into a single unit ready to be installed. The wood facing of the core filled panels includes wood stile and rail facing pieces and one or more raised panel subassemblies comprising a base panel to which is secured a raised panel with decorative wooden beads located at their perimeters which creates a wood picture frame look on the outer surfaces of the panels.

22 Claims, 4 Drawing Sheets

ENTRY DOOR SYSTEM

BACKGROUND OF THE INVENTION

This invention relates to a unique entry door system comprised of a plurality of uniquely constructed panels.

In the housing construction industry, entry doors are generally constructed of wooden frames with either a wooden door or a flush metal door. It is generally recognized that the wood door has a more beautiful aesthetic appearance. Attempts have been made to plant-on or add-on panels to the metal door to give it a better aesthetic appearance but to date, within our knowledge, there has been no completely satisfactory door developed in which a metal door is utilized to give the exceptional insulating qualities of such a door and at the same time produce the aesthetic appearance of a wood door.

Further, to our knowledge, no one has conceived of a panel construction using the insulating qualities of a metal panel with an insulating core that can be utilized for both a door panel and side panel and which gives the entire unit an aesthetic wood appearance.

Although a need has existed for versatile entrance systems from which a variety of styles, configurations, and miscellaneous options can be offered for a complete package, no such system has been devised.

SUMMARY OF THE INVENTION

In accordance with the present invention, we provide the unique construction for a decorative panel. This construction can be used for either the door or doors of a system or side panels mounted adjacent the door. This system permits providing a customer with a complete entry system including the door or doors and a side panel or side panels all encompassed within a frame so as to be shipped and sold as a complete entrance system.

The unique construction of the panels permits the use of the insulation advantages obtained by the use of a core-filled metal door while at the same time providing an authentic wooden look to the entire system be it just a single door, a door with one or two side panels or a combination of two doors with side panels. All of these panels are constructed of substantially the same components but of different size. The present invention permits the customer to order a system complete and ready to install. There is enough flexibility in the entire system to allow the customer to customize his system if he so chooses. For example, he can order a unit which includes a door with one side light, a door with side lights on each of the sides of the door or two doors with side lights on each of the doors. At the same time, the customer is assured of a beauty like that of an authentic wood door and wood side panels.

In accordance with this invention, the panels for both the door and the side panel are formed of metallic skin members secured at their side peripheral edges to stiles and at the top and bottom peripheral edges to rails. A polyurethane foam is injected into the space and formed in place so as to be bonded to the interior surfaces of the skin members and to the stiles and rails. This gives the panel exceptional insulating qualities.

The panel is given a wood-like appearance by securing to selected portions of the exterior surfaces of the skin members wood base panel elements. To these base panel elements is secured a raised panel element and wooden molding beads secured to the raised panel elements and the base panel elements along the peripheral edges of the raised panel elements.

Within a preferred embodiment of this invention, wooden stile facing pieces are secured to portions of the exterior surfaces of the skin member along adjacent and over the stile members and also over the rail members. This combination gives the door and side panels an authentic wood appearance so as to project the beauty of a wood door or doors and a side panel or panels.

Within the more specific preferred embodiment of this invention, a central portion of at least one of the exterior surfaces of the skin members is covered by a hardwood center rail which permits a design to be carved into the wood.

DETAILED DESCRIPTION OF THE PREFERRED EMBODIMENTS

Figure 2:
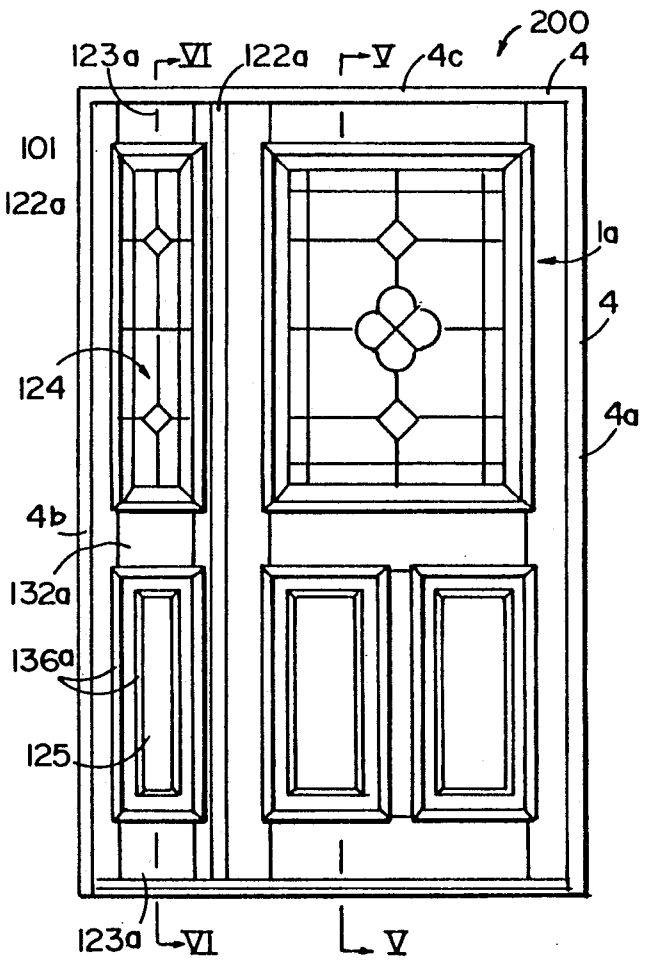
FIG. 2 is a front elevational view of the door entrance system of this invention in which a door and one side light is included.

Referring to the drawings, reference numerals 100, 200, 300 and 400 as disclosed in FIGS. 1, 2, 3 and 4, respectively, designate different entry systems constructed in accordance with the present invention. The entry system 100 of FIG. 1 includes only the door unit 1 with a frame 2. FIG. 2 discloses an entry system 200 which includes a door unit 1*a* of identical construction to the door unit 1 of FIG. 1 and a side panel or side light 101. The door 1*a* and side light 101 is framed by the frame 4. The entry unit 300 of FIG. 3 includes the door unit 1*b*, also identical to the door unit 1 of FIG. 1, and two side light units 101*a* and 101*b* identical to the side light unit 101 of FIG. 2. The side lights 101*a*, 101*b* and door unit 1*b* are framed by the frame 5. The entry system 400 of FIG. 4 includes the two door units 1*c* and 1*d* and the two side lights 101*c* and 101*d*. Door units 1*c* and 1*d* are identical to the door unit 1 of FIG. 1 and the side lights 101*c* and 101*d* are identical to the side light 101 of FIG. 2. The door units 1*c* and 1*d* and side lights 101*c* and 101*d* are framed by frame 6. In all of the entry systems the sill 7 is a treated wooden sill member 7*a* covered by an anodized sill cover 7*b*. Also the bottom edge of the door rail 21 is provided with a step which is contacted by the three-finned bottom sweep 8 to provide an excellent weather barrier.

Figure 7:
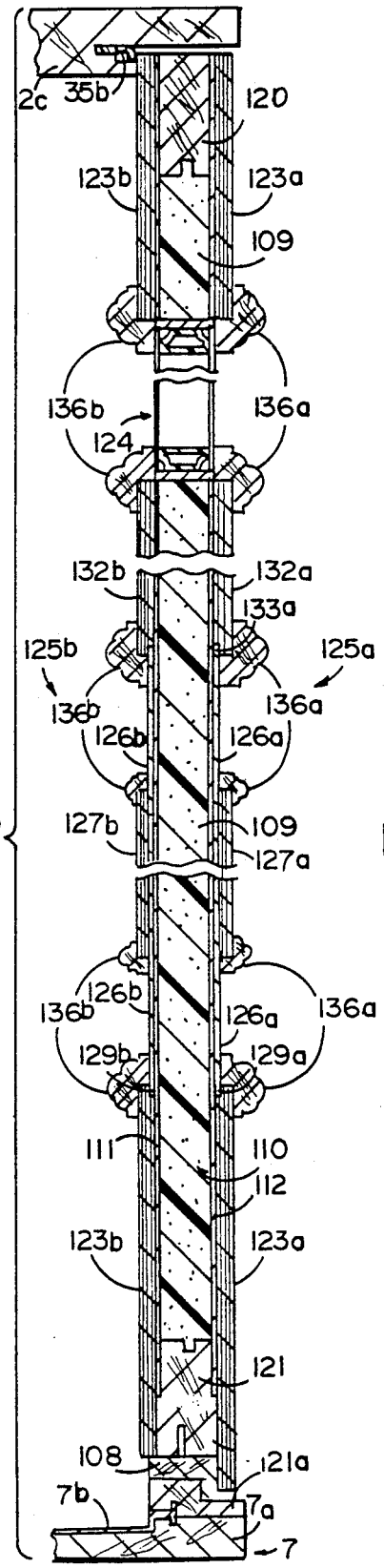
FIG. 7 is an elevational, cross-sectional view taken along the plane VII—VII of the side panel of FIGS. 2 and 3.
Figure 8:
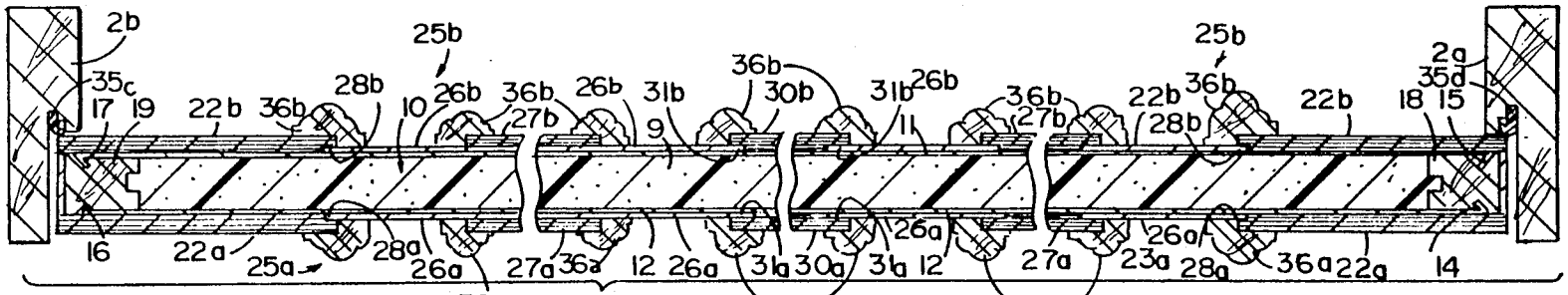
FIG. 8 is a cross-sectional view taken along the plane VIII—VIII of FIG. 1.
Figure 9:
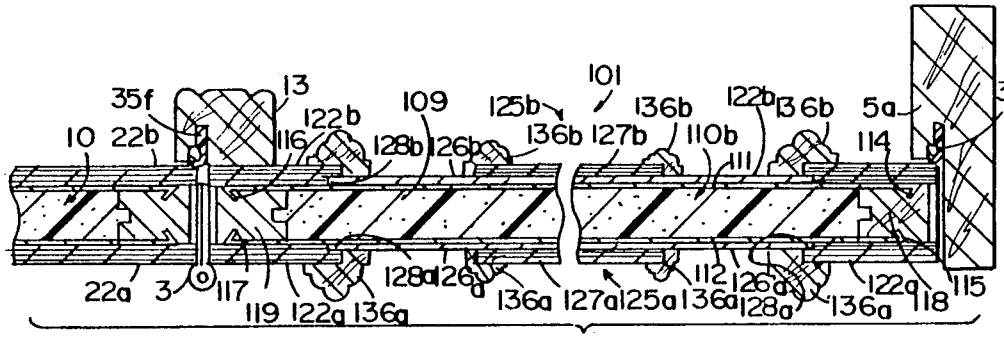
FIG. 9 is a cross-sectional view taken along the plane IX—IX of FIG. 3.
Figure 10:
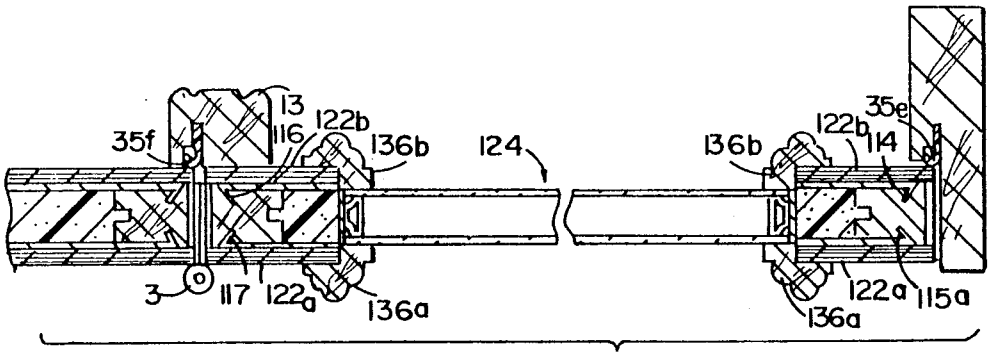
FIG. 10 is a cross-sectional view taken along the plane X—X of FIG. 3.

As disclosed in FIG. 8 the frame 2 of entry system 100 includes the side door jambs 2*a* and 2*b* and top door jamb 2*c*. The entry system 200 includes the door jamb 4*a* and side light jamb 4*b* and top jamb 4*c*. The frame 5 for entry system 300 of FIG. 3 includes the side light jambs 5*a* and 5*b* and upper door jamb 50. In both systems 200 and 300 the door units are hinged to a side light by a hinge 3. (FIGS. 9 and 10). An astragal like that shown at 13 in FIG. 9 is located between the side light and door unit. In system 400 one or both of the door units can be hinged to a side light by hinges like that of hinge 3. The frame 6 of system 400 includes the side light jambs 6*a* and 6*b* and upper door jamb 6*c*. Specially designed recesses are provided at appropriate places in the jambs and astragals in which compression-type vinyl covered foam weather stripping elements identified as 35*a* (FIGS. 5 and 6), 35*b* (FIG. 7), 35*c* and 35*d* (FIGS. 8 and 11) and 35*e* and 35*f* (FIGS. 9 and 10) are located.

As will be described hereinafter, the side lights 101, 101*a*, 101*b*, 101*c* and 101*d* are of the same composition as the door units and are screwed (not shown) to the door frame through the sill, head and side jambs. An inactive sill stop 108 replaces the sweep 8.

Figure 1:
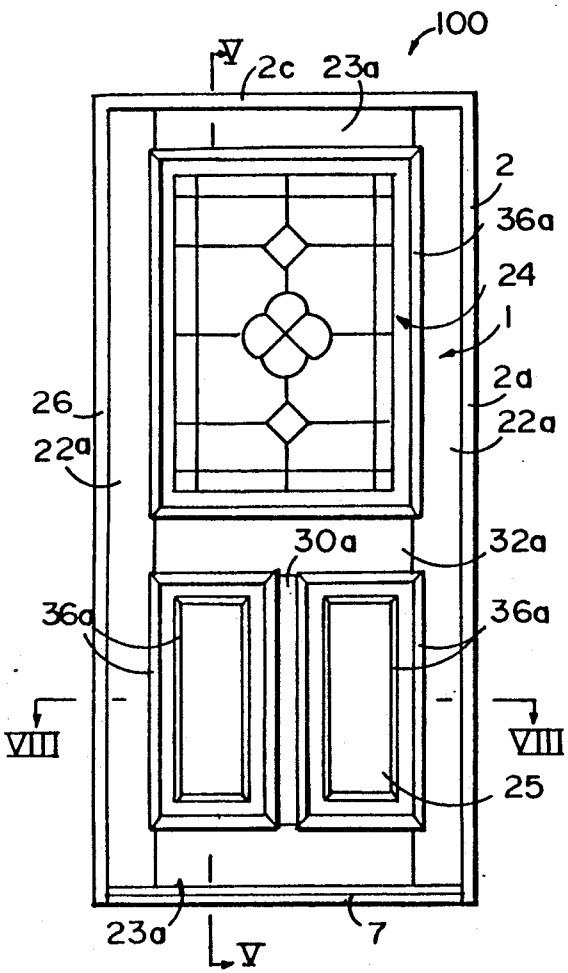
FIG. 1 is a front elevational view of an entrance system of this invention in which only the door is included.
Figure 4:
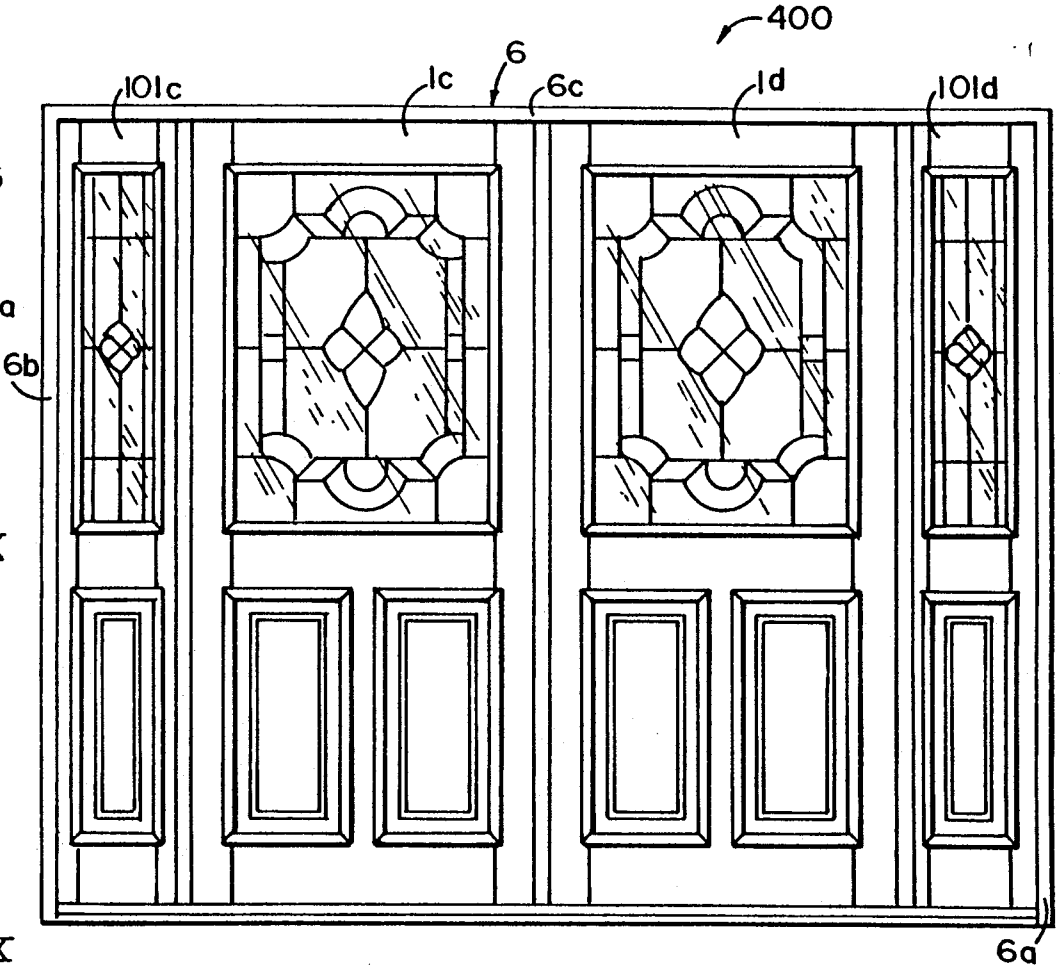
FIG. 4 is still another embodiment of this invention in which two doors and two side lights are included.
Figure 3:
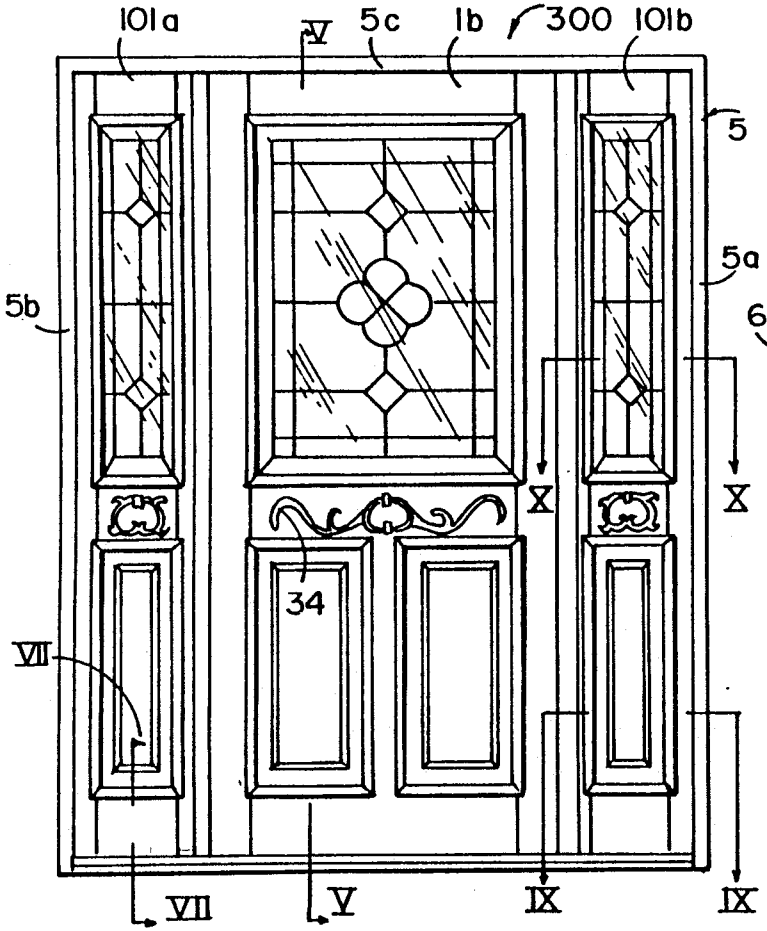
FIG. 3 is another embodiment of the entrance system of this invention in which a door and two side lights are included.

Since the construction of all of the door units of FIGS. 1–4 are identical, the description of the doors for all of the entry systems 100, 200, 300 and 400 will be described in relation to the door unit 1 of FIG. 1. Similarly, since all of the side lights 101*a*, 101*b*, 101*c* and 101*d* of FIGS. 2–4 are identical to side light 101, a description of the side lights will be restricted to the description of the side light 101 of FIG. 2.

Figure 6:
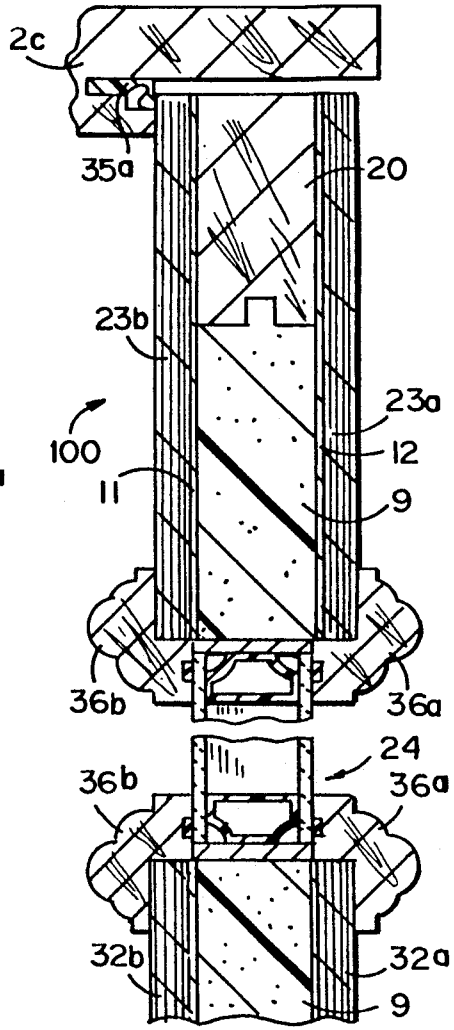
FIG. 6 is a partial, enlarged cross-sectional view of a portion of FIG. 5 at the top of the door.
Figure 5:
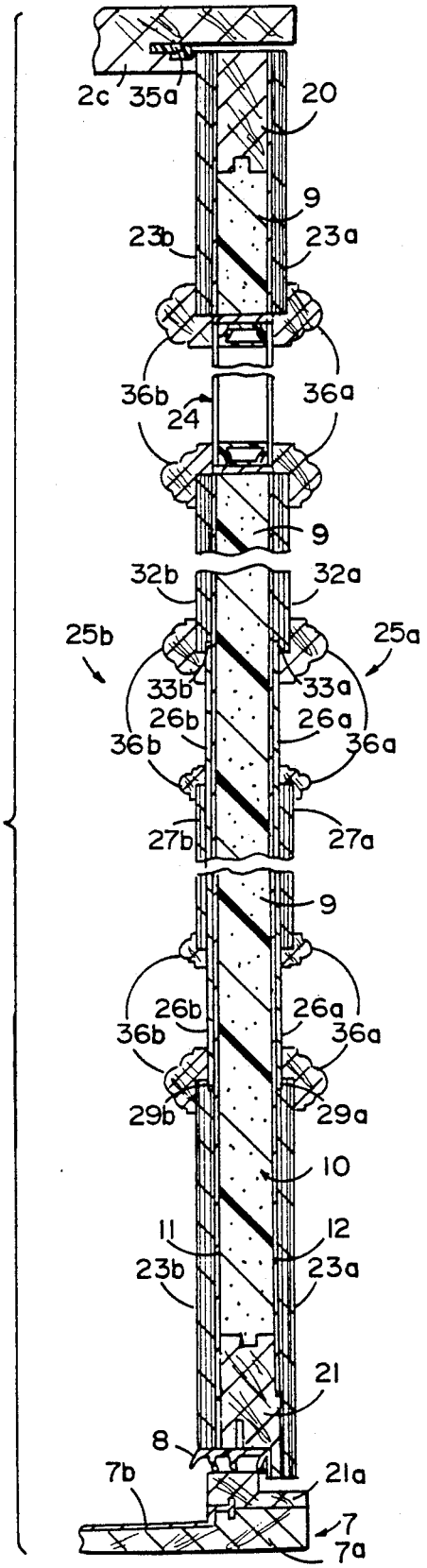
FIG. 5 is an elevational, cross-sectional view taken along the plane V—V of all of the FIGS. 1, 2 and 3.
Figure 11:
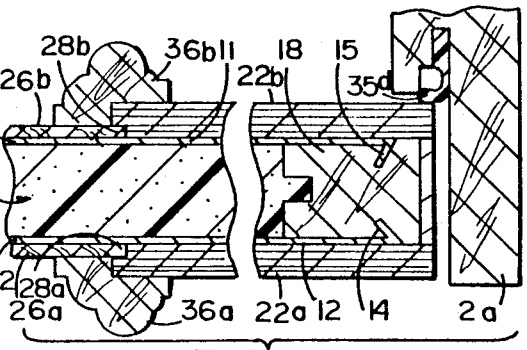
FIG. 11 is a partial, enlarged cross-sectional view of a right hand portion of FIG. 8.
Figure 12:
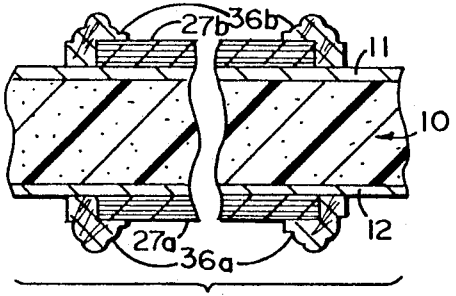
FIG. 12 is an enlarged cross-sectional view of a portion of FIG. 8 illustrating the relationship of some of the wood base panel elements, the raised panel elements and the wooden molding beads.

Referring now to FIGS. 5, 6, 8, 11 and 12, it will be observed that the door panel 1 is constructed of an inner metal skin member 11 and an outer metal skin member 12 spaced from each other. These metal skin members 11 and 12 are formed of a 24 gauge electro-galvanized steel. The vertical edges of the steel skin members are crimped at 14 and 15 along one edge and at 16 and 17 along the other edge (FIGS. 8 and 11). The crimped edges are inserted in grooves formed in the wood door stiles 18 and 19 and are also glued to the stiles with a contact cement sold under the trademark H. B. Fuller Maxbond 30. The top edges of the metal skin members 11 and 12 are also bonded to the top rail 20 and bottom rail 21 (FIGS. 5 and 6).

The space between the steel skin members 11 and 12, the stiles 18 and 19 and the rails 20 and 21 are injected with an isocyanate polyurethane foam 9 which is formed in place and permanently bonded to the steel skin members 11 and 12, the stiles 18 and 19 and the rails 20 and 21. This foam product is a Freeman Chemical, 30-2023, 150 cylinder, 30-1961 resin. The bonding of the polyurethane foam and the gluing of the wood door stiles and rails to the edges of the skin members 11 and 12 along with the connection of the crimped edges of the skin members to the stiles 18 and 19 prevents delamination and makes the core an integral part of the door system.

A raised wood panel effect is produced on the exterior faces of the skin members 11 and 12 by a unique arrangement of wood pieces glued onto each of the exterior surfaces of the inner and outer steel skin members 11 and 12.

The wood pieces on the outer skin member 12 include the stile wood facing pieces 22*a* (FIGS. 1 and 8) extending vertically along the edges of the door and covering the stiles 18 and 19 as well as a portion of the skin 12. The rail wood facing pieces 23*a* at both the top and bottom of the door cover the rails 20 and 21 and a portion of the skin 12. Between the wood facing pieces 22*a* and 23*a* is located the glass unit or window assembly 24 and raised panel assemblies 25. The glass unit 24 is of a conventional type and is fit into an opening cut in the core panel. If a glass unit is not preferred, other raised panel assemblies could be substituted for the glass unit, it being understood the opening would not then be provided.

The raised panel assemblies are a unique assembly which produces a design giving the door a raised panel effect. Each assembly (FIGS. 5, 8, 11 and 12) includes two base panels 26*a* with separate raised panels 27*a* glued thereto with a polyvinyl acetate Type I. The raised panels 27*a* are stapled from the back side to the base panel 26*a* before the base panel is glued on the skin 12. The combined thickness of base panel 26*a* and raised panel 27*a* is the same as the thickness of each of the pieces 22*a* and 23*a*. It will be noted in FIGS. 5 and 8 that the facing pieces 22*a* and 23*a* include recesses 28*a* and 29*a* respectively which receive base panels 26*a* so that the side facing pieces 22*a* and bottom facing pieces 23*a* slightly overlap the edges of the base panels 26*a*.

A vertically extending center piece 30*a* is located between the two raised panel assemblies 25*a*. Piece 30*a* is of the same thickness as pieces 22*a* and 23*a* and also includes the recess 31*a* for receiving the edges of the base panels 26*a* so as to overlap the same. Further, a center rail 32*a* (FIG. 5) extends laterally across the door between the two stile facing pieces 22*a*. It covers the space between the window assembly 24 and the raised panel assemblies 25*a*. It also is of the same thickness as pieces 22*a* and 22*b* and has a recess 33*a* receiving the top edges of and overlapping the base panels 26*a*. The center rail is a thick solid hardwood piece on which a decorative design 34 can be carved as disclosed in FIG. 3. A number of decorative wood beads or moldings 36*a* are secured to the various wood pieces as disclosed in the drawings to create a double picture frame look and also add greater strength at the joints between the separate parts.

The material from which the various wood pieces as above described are constructed is as follows. Base panels 26*a* are constructed from 3-ply wood, a hardwood veneer of vertical grain on each side of a wood core with a horizontal grain. The rough thickness is 0.129 inches but when sanded is finished to a thickness of 0.100 inches. The raised panels 27*a* are formed of a 5-ply wood product consisting of three plys of wood core covered on each side by a hardwood veneer of vertical grain. The original rough thickness of this 5-ply panel is 0.255 inches which is finished to a thickness of 0.250 inches. The 5-ply stile and rail facing pieces are constructed of three plys of wood covered on each side by a hardwood veneer which in the rough has a thickness of 0.366 inches and is finished to 0.350 inches thickness. The center piece 30*a* has the same construction as the stile and rail facing pieces.

All of the above wood facing pieces are permanently bonded to the outer skin member 12. This is accomplished by first assembling the raised panels to the base panels as above described. Each of the wood pieces are permanently bonded to the steel skin member 12 with an exterior glue. Obviously where the parts are to be stapled from the back, the stapling is accomplished before the part is glued to steel skin member 12.

So far the entire description has been related to the exterior surface of the door. The interior surface of the door has an identical construction. That is, it includes the inner wood stile facing pieces 22*b*, the inner wood rail facing pieces 23*b*, the raised panel assemblies 25*b*, the base panels 26*b*, the raised panels 27*b*, recesses 28*b* and 29*b* in the facing pieces 22*b* and 23*b*, center piece 30*b*, recesses 31*b*, center rail 32*b* with recesses 33*b* and the wood beads or molding 36*b*. It is not considered necessary to repeat a detailed description of such elements because of their identity to the elements on the exterior of the door.

FIGS. 7, 9 and 10 disclose in greater detail the side panel or side lights 101, 101*a*, 101*b*, 101*c* and 101*d* previously referred to. Since the construction of all of these side lights are the same, only one description of side light 101 will be made.

Referring to FIGS. 7 and 9, it will be noted that the side light 101 has substantially the same composition as the door unit 1, the primary difference being in the size. Thus, the side light 101 includes the core panel 110 having the inner steel skin member 111 and the outer steel skin member 112 both of which have crimped edges 114, 115, 116 and 117 which are connected to the stiles 118 and 119. (FIGS. 9 and 10) Skin members 111 and 112 are also connected to the rails 120 and 121. (FIG. 7) The space between the skin members 111 and 112, stiles 118 and 119 and rails 120 and 121 are filled with a foam 109 as described above in relation to the description of the door 1.

The side light includes a conventional type of window assembly 124 located between the wood stile facing pieces 122*a* and 122*b* as disclosed in FIGS. 10 and 2. Raised panel assembly 125*a* is located below the window assembly 124 on the exterior of the side light and raised panel assembly 125*b* is located below the window assembly 124 on the inside of the side light.

The raised panel assembly 125*a* includes the base panel 126*a* to which is secured the raised panel 127*a*. The vertical edges of the base panel 126*a* fit into the recesses 128*a* of the outer wood stile facing pieces 122*a*. The upper and lower edges of the base panels fit into the recess 129*a* of the rail facing piece 123*a*. A center rail 132*a* is provided to fill in the space between the raised panel assembly 125*a* and the window assembly 124*a*. It also has a recess 133*a* receiving the top edge of the base panel 126*a*. Wooden molding beads 136*a* are provided around the peripheries of base panel 126*a* and raised panel 127*a* as described above in the description of door unit 1.

It should be understood as previously described that the inside surface of the core panel 110 includes the same facing as that on the exterior surface just described. Accordingly, it includes the inner wood stile facing pieces 122*b*, the inner wood rail facing pieces 123*b*, the raised panel assembly 125*b* which includes the base panel 126*b* and raised panels 127*b*, the center rail 132*b* and the wood beads or moldings 136*b* all as previously described in relationship to the outer exterior of side light 101.

Method of Construction

Each of the two panels forming the door unit 1 and the side panel or side lights 101 are constructed by first providing two steel flat sheets of 24 gauge electro-galvanized steel skin of sufficient size to form the two skin members 11 and 12. Steel sheets are then sheared to the proper size. The two sheets are then rolled and crimped on the two sides to form the crimped edges 14, 15, 16 and 17. A wood frame is then constructed of the stiles 18 and 19 and rails 20 and 21. The stiles include slots for receiving the crimped edges 14, 15, 16 and 17. Two skin members 11 and 12 are then attached to the stiles by sliding the crimped edges into the slots provided in the stiles.

The above subassembly is then put into a press and the isocyanate polyurethane foam such as a Freeman Chemical, 30-2023, 150 cylinder, 30-1961 resin, is injected through an opening in the bottom rail 21 into the space between the skin members 11 and 12 and the stiles 18, 19 and rails 20 and 21.

When the resin is injected in the space, it expands and becomes permanently bonded to the interior surface of the steel skin members 11 and 12 and also the stiles 18 and 19 and rails 20 and 21. This prevents delamination and makes the core an integral part of the door unit. Each raised panel assembly is then constructed by providing a base panel 26*a* to which is secured the raised panel 27*a* by means of a polyvinyl acetate Type I exterior glue and stapling the raised panel 27*a* from the back side to the base panel 26*a*. The wood stile facing pieces 22*a* and 22*b*, the wood rail facing pieces 23*a* and 23*b*, the center pieces 30*a* and 30*b* and center rails 32*a* and 32*b* are all provided in the appropriate size and shape, each of such members including the recesses as described above to provide the overlapping type joints with the raised panel assembly. These joints are all glued with a polyvinyl acetate Type I exterior glue and stapled from the back side with two staples per joint. This wood facing construction is then permanently bonded to the steel insulated core panel 10 with an exterior glue. This is accomplished on both of the exterior surfaces of inner steel skin member 11 and outer steel skin member 12. The entire unit is then inserted in a press while the glue is setting. The edges of the unit are then trimmed to provide the specific width and length of the door unit. If the glass unit is to be provided, the opening for the glass unit is then cut out.

After the glue has set, the unit is removed from the press and sanded on both sides. The window assembly is then inserted and secured in place after which the moldings or beads 36*a* and 36*b* are caulked and stapled at the seams between the various parts to create a double picture frame look and add greater strength at the joints between the separate parts.

Having described the method of constructing and assembling the door unit 1, it should be understood that a substantially similar method is utilized for constructing and assembling the side panels or side light 101. Therefore it is not necessary to repeat the various steps as described above.

Having described the preferred embodiment of my invention, it should become evident that the purpose of it is to provide the customer with a complete entrance system. My invention provides for a variety of styles, configurations, trims and miscellaneous options. The customer is able to order a system complete and ready to install, be it a single door, a single door and a single side panel, a single door with a double side panel or a double door with a double side panel. In other words, this invention provides sufficient flexibility for the customer so as to allow him to customize his system if he so chooses. My invention provides for an entry system with an exceptional insulating quality while projecting the beauty of a wood door.

Although I have disclosed preferred embodiments of my invention, it should be understood that other embodiments and modifications thereof can be obtained utilizing my concepts without deviating from the real spirit of this invention. Therefore, my invention should be limited only as set forth in the following claims.

We claim:

1. A door entry system comprising a plurality of decorative panels, at least one of said panels being a door and at least one of the other panels being a decorative side panel located along the side of said door; a frame about all of said panels; each of said panels comprising:

spaced metallic skin members; stile members secured to the side peripheral edges of said skin members; rail members secured to the top and bottom edges of said skin members; an opening cut in said skin members at an upper portion thereof and spaced from said stile member and said top rail member; a glass unit mounted in said opening; rigid insulation material located in the space between said skin members and said stile and rail members; at least one raised panel assembly secured to the exterior surface of at least one of said skin members below and spaced from said stile member, bottom rail member and said glass unit; said raised panel assembly including a wood base panel element secured to said one skin member and a raised panel element secured to the face of said wood base panel opposite said one skin member; wooden stile facing pieces extending vertically along the vertical edges of said panel and secured to said exterior surface between the vertical edges of said panel and the glass unit and the raised panel assembly; wooden rail facing pieces extending horizontally along the top and bottom edges of said panel from one to the other of said stile facing pieces and secured to said exterior surface between said glass unit and top edge of said panel and between said raised panel assemblies and bottom edge of said panel; a wooden center rail extending horizontally between said stile facing pieces and filling the space between said glass unit and raised panel assembly; molding beads secured to said raised panel elements and base panel element around the periphery of said raised panel elements; and molding beads secured to said base panel element, said stile facing pieces, said bottom rail pieces, and said center rail around the periphery of said base panel elements.

2. The door entry system of claim 1 in which a raised panel assembly, stile facing pieces, said rail facing pieces, wooden center rail and molding beads all as defined in claim 1 are mounted on the exterior surfaces of both of said skin members.

3. The door entry system of claim 1 in which two raised panel assemblies spaced horizontally from each other are mounted below said glass unit; a central wooden filler piece extending vertically and between said raised panel assemblies; said molding beads also being secured to said central filler piece.

4. The door entry system of claim 1 in which said panels include one door panel and one decorative side panel on a side of said door panel.

5. The door entry system of claim 1 in which said panels include one door panel and two decorative side panels on each side.

6. The door entry system of claim 1 in which said panels include two door panels and two decorative side panels on each side thereof.

7. The door entry system of claim 1 in which each panel is a polyurethane foam injected into said space and formed in place and bonded to the interior surfaces of said skin members.

8. A decorative panel for an entrance system or the like comprising spaced metallic structural skin members; stile members secured to and supported between the side peripheral edges of said skin members; rail members secured to and supported between the peripheral top and bottom edges of said skin members; rigid insulation material located in the space between said skin members and said stile and rail members; at least one raised panel assembly secured to and supported on a selected portion of the exterior surface of at least one of said skin members comprising a wood base panel element secured to said selected portion; a raised panel element secured to selected exterior surfaces of said wood base panel element; and wooden molding beads secured to said raised panel element and base panel element along the peripheral edges of said raised panel element and along the peripheral edges of said base panel element to cover the joints between said base panel and said raised panel element.

9. A decorative panel for an entrance system or the like comprising spaced metallic skin members; stile members secured to the side peripheral edges of said skin members; rail members secured to the peripheral top and bottom edges of said skin members; rigid insulation material located in the space between said skin members and said stile and rail members; at least one raised panel assembly secured to a selected portion of the exterior surface of at least one of said skin members comprising a wood base panel element secured to said selected portion; a raised panel element secured to selected exterior surfaces of said wood base panel element; wooden molding beads secured to said raised panel element and base panel element along the peripheral edges of said raised panel element and along the peripheral edges of said base panel element; and said rigid core being a polyurethane foam injected into said space and formed in place and bonded to the interior surfaces of said skin members.

10. A decorative panel for an entrance system or the like comprising spaced metallic skin members; stile members secured to the side peripheral edges of said skin members; rail members secured to the peripheral top and bottom edges of said skin members; rigid insulation material located in the space between said skin members and said stile and rail members; at least one raised panel assembly secured to a selected portion of the exterior surface of at least one of said skin members comprising a wood base panel element secured to said selected portion; a raised panel element secured to selected exterior surfaces of said wood base panel element; wooden molding beads secured to said raised panel element and base panel element along the peripheral edges of said raised panel element and along the peripheral edges of said base panel element; and wooden stile facing pieces secured to portions of said exterior surface of said one skin member along, adjacent and over the stile members.

11. A decorative panel for an entrance system or the like comprising spaced metallic skin members; stile members secured to the side peripheral edges of said skin members; rail members secured to the peripheral top and bottom edges of said skin members; rigid insulation material located in the space between said skin members and said stile and rail members; at least one raised panel assembly secured to a selected portion of the exterior surface of at least one of said skin members comprising a wood base panel element secured to said selected portion; a raised panel element secured to selected exterior surfaces of said wood base panel element; wooden molding beads secured to said raised panel element and base panel element along the peripheral edges of said raised panel element and along the peripheral edges of said base panel element; and wooden rail facing pieces secured to portions of said exterior surface of said one skin member along, adjacent and over the rail members.

12. A decorative panel for an entrance system or the like comprising spaced metallic skin members; stile members secured to the side peripheral edges of said skin members; rail members secured to the peripheral top and bottom edges of said skin members; rigid insulation material located in the space between said skin members and said stile and rail members; at least one raised panel assembly secured to a selected portion of the exterior surface of at least one of said skin members comprising a wood base panel element secured to said selected portion; a raised panel element secured to selected exterior surfaces of said wood base panel element; wooden molding beads secured to said raised panel element and base panel element along the peripheral edges of said raised panel element and along the peripheral edges of said base panel element; and wooden facing pieces secured to portions of the exterior surfaces of said skin member along, adjacent and over the stile members and also along, adjacent and over the rail members.

13. A decorative panel for an entrance system or the like comprising spaced metallic skin members; stile members secured to the side peripheral edges of said skin members; rail members secured to the peripheral top and bottom edges of said skin members; rigid insulation material located in the space between said skin members and said stile and rail members; at least one raised panel assembly secured to a selected portion of the exterior surface of at least one of said skin members comprising a wood base panel element secured to said selected portion; a raised panel element secured to selected exterior surfaces of said wood base panel element; wooden molding beads secured to said raised panel element and base panel element along the peripheral edges of said raised panel element and along the peripheral edges of said base panel element; and a center rail of solid hardwood secured horizontally to a central horizontal portion of at least one of the skin members, said center rail overlapping an adjacent edge of a wood base panel element.

14. A door entrance system comprising a plurality of decorative panels, at least one of said panels being a door and at least one of the other panels being a decorative side panel located along the side of said door; a frame about all of said panels; each of said panels comprising:

spaced metallic skin members; stile members secured to the side peripheral edges of said skin members; rail members secured to the peripheral top and bottom edges of said skin members; rigid insulation material located in the space between said skin members and said stile and rail members; wood base panel elements secured to selected portions of the exterior surfaces of said skin members; raised panel elements secured to selected exterior surfaces of said wood base panel elements; and wooden molding beads secured to said raised panel elements and base panel elements along the peripheral edges of said raised panel elements and along the peripheral edges of said base panel elements.

15. The door entry system of claim 14 in which said panels include one door panel and one decorative side panel on the side of said door panel.

16. The door entry system of claim 14 in which said panels include one door panel and two decorative side panels on each side.

17. The door entry system of claim 14 in which said panels include two door panels and two decorative side panels on each side thereof.

18. The door entry system of claim 14 in which each panel is a polyurethane foam injected into said space and formed in place and bonded to the interior surfaces of said skin members.

19. The door entry system of claim 14 in which wooden stile facing pieces are secured to portions of the exterior surfaces of said skin member along, adjacent and over the stile members.

20. The door entry system of claim 14 in which wooden rail facing pieces are secured to portions of the exterior surfaces of said skin member along, adjacent and over the rail members.

21. The door entry system of claim 14 in which wooden stile facing pieces are secured to portions of the exterior surfaces of said skin member along, adjacent and over the stile members and also along, adjacent and over the rail members.

22. The door entry system of claim 14 in which in each panel a center rail of solid hardwood is secured horizontally to a central horizontal portion of at least one of the skin members, said center rail overlapping an adjacent edge of a wood base panel element.

* * * * *